US005986530A

United States Patent [19]

Nippert et al.

[11] Patent Number: 5,986,530

[45] Date of Patent: Nov. 16, 1999

[54] SOLENOID AND METHOD FOR MANUFACTURING

[75] Inventors: Andrew H. Nippert; Paul D. Moser, both of Peoria; Michael J. Orr, Morris; Brett A. Jones, Peoria; Gregory J. Kimberley, East Peoria, all of Ill.

[73] Assignee: Caterpillar Inc., Peoria, Ill.

[21] Appl. No.: 09/006,119

[22] Filed: Jan. 13, 1998

[51] Int. Cl.[6] ..... H01F 7/20

[52] U.S. Cl. ..... 335/289; 29/606

[58] Field of Search ..... 335/296–7, 289; 192/84 A, 84 L; 336/192, 198, 208; 29/605–6

[56] References Cited

U.S. PATENT DOCUMENTS

| | | | |
|---|---|---|---|
| 1,209,646 | 12/1916 | Reed . | |
| 2,258,913 | 10/1941 | Stone . | |
| 2,860,403 | 11/1958 | Meyer . | |
| 3,022,450 | 2/1962 | Chase, Jr. . | |
| 3,909,758 | 9/1975 | Hans et al. . | |
| 4,004,343 | 1/1977 | Marsden | 29/596 |
| 4,211,278 | 7/1980 | Bennett et al. . | |
| 4,524,947 | 6/1985 | Barnes et al. . | |
| 4,540,154 | 9/1985 | Kolchinsky et al. . | |
| 4,633,554 | 1/1987 | Clark et al. . | |
| 4,659,005 | 4/1987 | Spindler . | |
| 4,725,039 | 2/1988 | Kolchinsky . | |
| 5,144,973 | 9/1992 | Green et al. . | |
| 5,208,570 | 5/1993 | Nippert . | |
| 5,529,283 | 6/1996 | Knecht et al. . | |

FOREIGN PATENT DOCUMENTS

| | | |
|---|---|---|
| 19 64 297 | 6/1971 | Germany . |
| 25 02 714 | 9/1975 | Germany . |
| 35 02 287 | 7/1986 | Germany . |
| 36 35 551 | 4/1988 | Germany . |
| 42 37 405 | 6/1993 | Germany . |
| 62-110014 | 5/1987 | Japan . |
| 63-55420 | 4/1988 | Japan . |

*Primary Examiner*—Lincoln Donovan

*Attorney, Agent, or Firm*—O. Gordon Pence; Kevin M. Kercher; David G. Schmaltz

[57] ABSTRACT

An improved method for manufacturing a solenoid. The method includes the step of providing a single piece ferromagnetic housing. The method also includes the step of forming a groove around the perimeter of the housing. The method further includes the step of filling the groove with a non-ferromagnetic material such that the non-ferromagnetic material forms an annular ferromagnetic piece that spans the entire groove in the housing. Finally, the method includes the step of removing an inside portion of the housing such that two separate ferromagnetic pieces are formed joined by the non-ferromagnetic piece.

7 Claims, 7 Drawing Sheets

SOLENOID AND METHOD FOR MANUFACTURING

TECHNICAL FIELD

The present invention relates generally to solenoids and methods for making the same. More particularly, the present invention relates to proportional solenoids and methods for making the same.

BACKGROUND ART

Proportional solenoids are well known in the art and provide a force versus stroke curve that allows the output force of the solenoid to be proportional to the electrical current applied to the coil and that is independent of armature position over the working range of the stroke. This proportionality of the output force permits such a solenoid to either fully or partially operate a load by selectively applying either full or partial electrical current to the solenoid coil, thereby delivering a selective output force.

A typical solenoid includes a removable coil unit, an armature assembly, and an armature housing. The armature assembly includes an armature and a push pin that are reciprocally mounted within the armature housing. The armature housing includes a stator and a tube section in which the armature reciprocates. When electrical current is applied to the coil unit, the armature assembly moves longitudinally within the armature housing in response to a magnetic flux path established by the solenoid coil. The output force generated by the solenoid is dependent upon the amount of electrical current applied to the solenoid coil. A variety of concerns relate to the manufacture of solenoids. One concern relates to manufacturing a durable solenoid at a competitive price. Another concern relates to manufacturing a solenoid having a minimum number of parts. A further concern relates to minimizing run-out within a given solenoid. Still a further concern relates to manufacturing a solenoid that is easy to assemble and repair. An additional concern relates to providing a reliable solenoid at a reduced cost. A further concern relates to overcoming dilution and diffusion problems associated with heating an armature housing during the manufacturing process. Moreover, a further concern relates to providing a simplified solenoid manufacturing process that yields a solenoid capable of withstanding the extreme conditions presented by construction vehicles.

DISCLOSURE OF THE INVENTION

One aspect of the present invention relates to an improved method for manufacturing a solenoid. The method includes the step of providing a single piece ferromagnetic housing. The method also includes the step of forming a groove around the perimeter of the housing. The method further includes the step of filling the groove with a non-ferromagnetic material such that the non-ferromagnetic material forms an annular ferromagnetic piece that spans the entire groove in the housing. Finally, the method includes the step of removing an inside portion of the housing such that two separate ferromagnetic pieces are formed joined by the non-ferromagnetic piece.

Another aspect of the present invention relates to a solenoid including a housing having a groove extending about its perimeter. The groove divides the housing into first and second separate ferromagnetic pieces. An armature-pin assembly, including an armature and a pin, are reciprocally mounted within the housing. The groove of the housing is filled by a non-ferromagnetic piece that separates the first and second ferromagnetic pieces. The non-ferromagnetic piece is arranged and configured to form a first bearing for supporting within the housing the armature of the armature-pin assembly.

The various methods and apparatuses in accordance with the principles of the present invention provide a solenoid that can be efficiently manufactured and that utilizes a minimal number of parts. Furthermore, the various aspects of the present invention provide a solenoid having a main body machine from a single piece of ferromagnetic bar stock, thereby avoiding concentricity problems associated with prior solenoid tube assemblies. Furthermore, various aspects of the present invention provide a solenoid that is durable, easy to assemble, and efficient to manufacture.

A variety of additional advantages of the invention will be set forth in part in the description which follows, and in part will be apparent from the description, or may be learned by practicing the invention. It is to be understood that both the foregoing general description and the following detailed description are exemplary and explanatory and are not restrictive of the invention as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. A brief description of the drawings is as follows.

INDUSTRIAL APPLICABILITY

Reference will now be made in detail to exemplary embodiments of the present invention which are illustrated in the accompanying drawings. Wherever possible, the same reference numbers will be used throughout the drawings to refer to the same or like parts.

Figure 1:
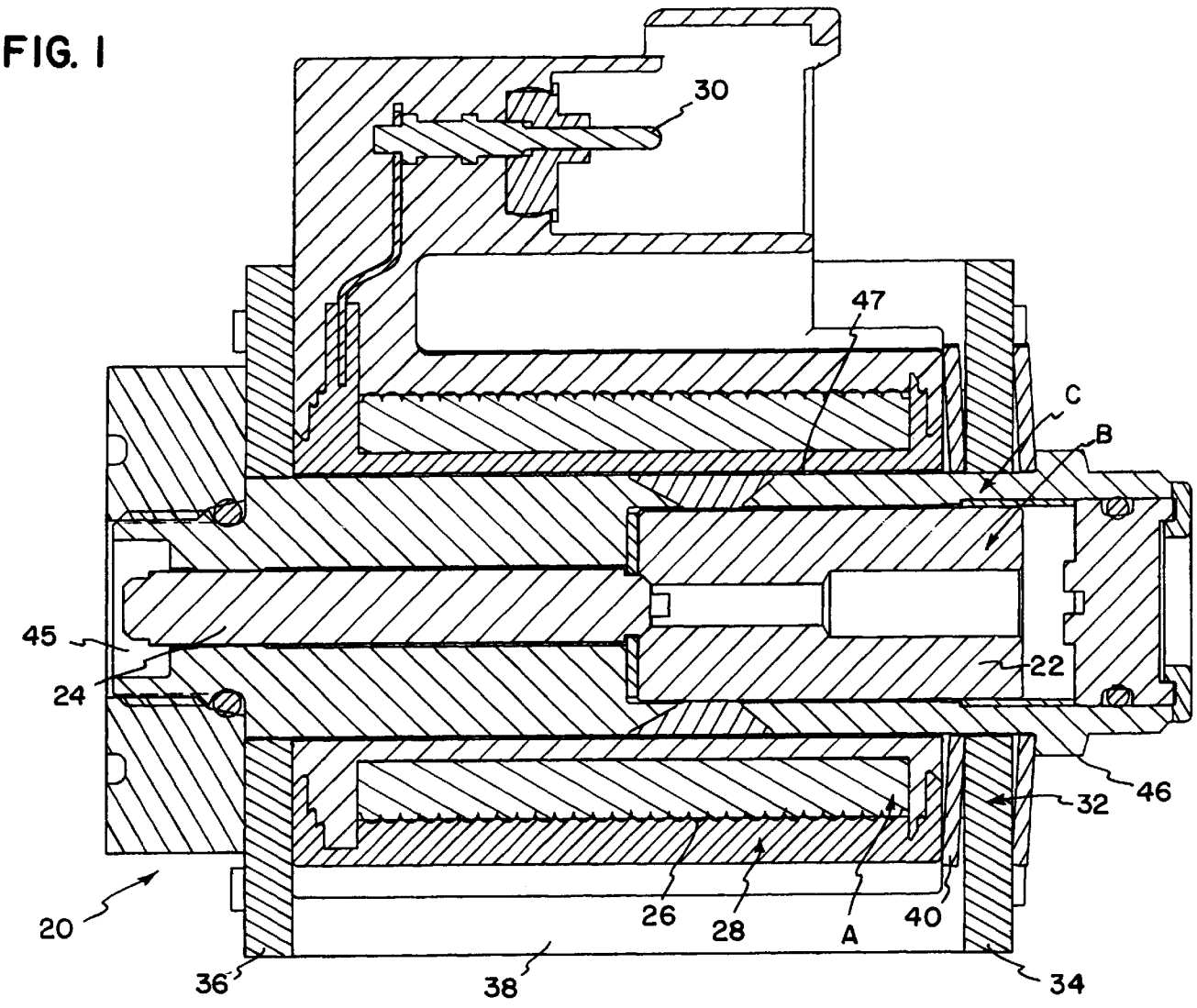
FIG. 1 is a partial cross-sectional view of a solenoid constructed in accordance with the principles of the present invention.

FIG. 1 illustrates a solenoid 20 constructed in accordance with the principles of the present invention. The construction of the solenoid is readily adaptable to proportional solenoids such as those used to operate hydraulic valves. Also, this invention is readily adaptable to push-pull solenoids, as would be apparent to one skilled in the art.

Referring to FIG. 1, the solenoid 20 includes a removable coil unit A, an armature assembly B, and an armature housing C. The armature housing includes a stator and a tube section in which the armature reciprocates. The armature assembly B is reciprocally mounted within the armature housing C and includes an armature 22 and an armature pin 24. In use, the armature assembly B is selectively reciprocated within the armature housing C by magnetic flux generated by the coil unit A.

The removable coil unit A includes a coil 26 having a construction that is commonly known in the art. The coil 26 is contained within a coil housing 28 that is equipped with an electrical connector 30 for allowing the coil 26 to be electrically connected to a controller that regulates current applied to the coil 26.

The coil unit A also includes a coil mounting assembly 32 for mounting the coil 26 on the armature housing C. The mounting assembly 32 includes first and second spaced apart generally rectangular plates 34 and 36. The first and second plates 34 and 36 are maintained in a spaced apart relationship by spacing members 38 that are fixably connected to the corners of the plates 34 and 36. Besides maintaining the spacing between the first and second plates 34 and 36, the spacer members 38 also function to retain the coil housing 28 within the mounting assembly 32. To prevent vibration of the coil housing 28 relative to the mounting assembly 32, a belleville washer 40 is respectively positioned between the coil housing 28 and the first plate 34. The coil mounting assembly 32 is riveted together using a process that is commonly known in the art and thus is treated as a single component.

To mount the coil unit A on the armature housing C, the coil unit A is inserted over a second end 45 of the armature housing C and moved along the armature housing C until the first plate 34 engages a flange 46 formed about the perimeter of the armature housing C. To facilitate inserting the coil unit A over the armature housing C, the coil unit A defines a central bore 47 sized to receive the armature housing C. Specifically, the central bore 47 is formed by coaxially aligned openings defined by the coil unit A, the first and second plates 34 and 36, and the belleville washer 40.

Figure 3:
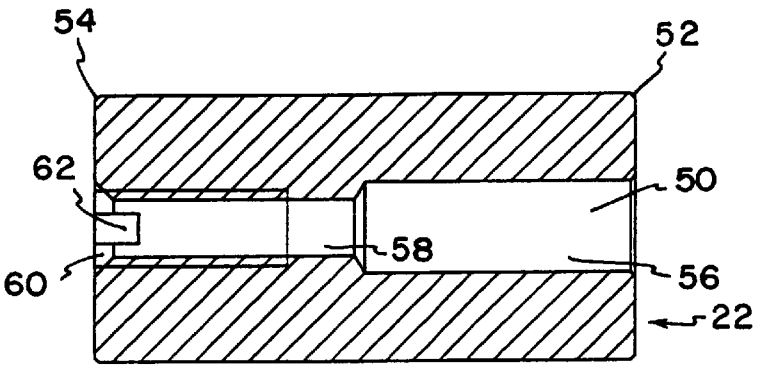
FIG. 3 is a cross-sectional view taken along section line 3—3 of FIG. 2.
Figure 2:
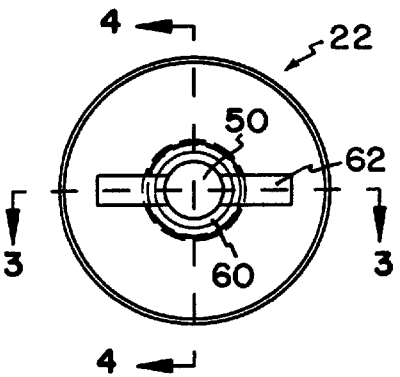
FIG. 2 is an end view of a solenoid armature constructed in accordance with the principles of the present invention.
Figure 4:
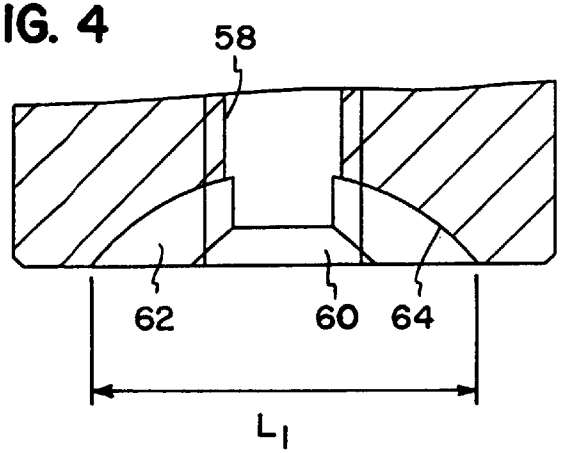
FIG. 4 is a cross-sectional view taken along section line 4—4 of FIG. 2.

Referring now to FIGS. 2–4, the armature 22 of the armature assembly B is generally cylindrical and defines a central fluid passage 50 for allowing oil to flow through the armature 22 as the armature 22 is reciprocated within the armature housing C. The fluid passage 50 is concentric with respect to the armature 22 and extends longitudinally between oppositely located first and second ends 52 and 54 of the armature 22. The fluid passage 50 includes an enlarged diameter portion 56 located adjacent to the first end 52 and a reduced diameter portion 58 located adjacent to the second end 54. The reduced diameter portion 58 preferably has a diameter that is less than the width of the armature pin 24. The enlarged diameter portion 56 is enlarged with respect to the reduced diameter portion 58 in order to minimize the mass of the armature 22 thereby increasing the responsiveness of the solenoid. The enlarged diameter portion 56 also effectively shortens the length of the reduced diameter portion 58, making manufacturing of the drilled hole easier.

The armature 22 also includes a chamfered pin receiving portion 60 located at the second end 54 of the armature 22. The pin receiving portion 60 is coaxially aligned with the fluid passage 50 and is sized for receiving an end of the armature pin 24. The armature 22 further includes a bypass slot 62 that extends transversely across the chamfered portion 60. As shown in FIG. 4, the bypass slot 62 is in fluid communication with the reduced diameter portion 58 of the fluid passage 50 and has a curved inner wall 64. The bypass slot 62 is arranged and configured to allow fluid to flow through the fluid passage 50 even when the armature pin 24 is inserted in the pin receiving portion 60. Consequently, it is preferred for the bypass slot 62 to have a length $L_1$ that is greater than the width of the armature pin 24.

Figure 6:
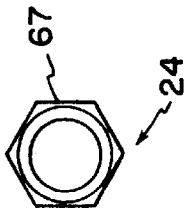
FIG. 6 is a right-end view of the push pin of FIG. 5.
Figure 5:
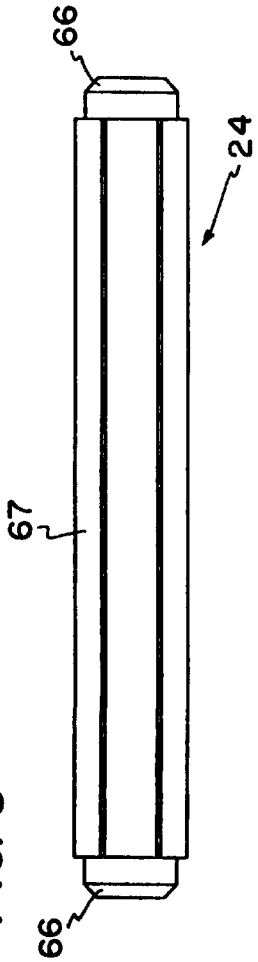
FIG. 5 illustrates a solenoid push pin constructed in accordance with the principles of the present invention.

As shown in FIGS. 5 and 6, the armature pin 24 is elongated and has at least one end portion 66 that is chamfered. It is preferred for the armature pin 24 to have at least one flat surface extending lengthwise along the pin 24. As shown in FIG. 6, the pin 24 has a hexagonal cross-section such that the pin has six separate flat surfaces 67. At least one of the chamfered end portions 66 is round and sized to fit within the pin receiving portion 60 of the armature 22. When the armature assembly B is mounted within the solenoid 20, the armature pin 24 is preferably not fixably connected to the armature 22. Instead, a loose connection exists between the armature pin 24 and the armature 22 with one of the chamfered end portions 66 of the pin 24 fitting within the chamfered pin receiving portion 60 of the armature 22.

The armature 22 is preferably machined from a ferromagnetic material such as resulfurized or leaded low-carbon free machining steel or other ferromagnetic material such as silicon ion steel. The armature pin 24 is preferably machined from a non-ferromagnetic material such as austnitic stainless steel.

Figure 7:
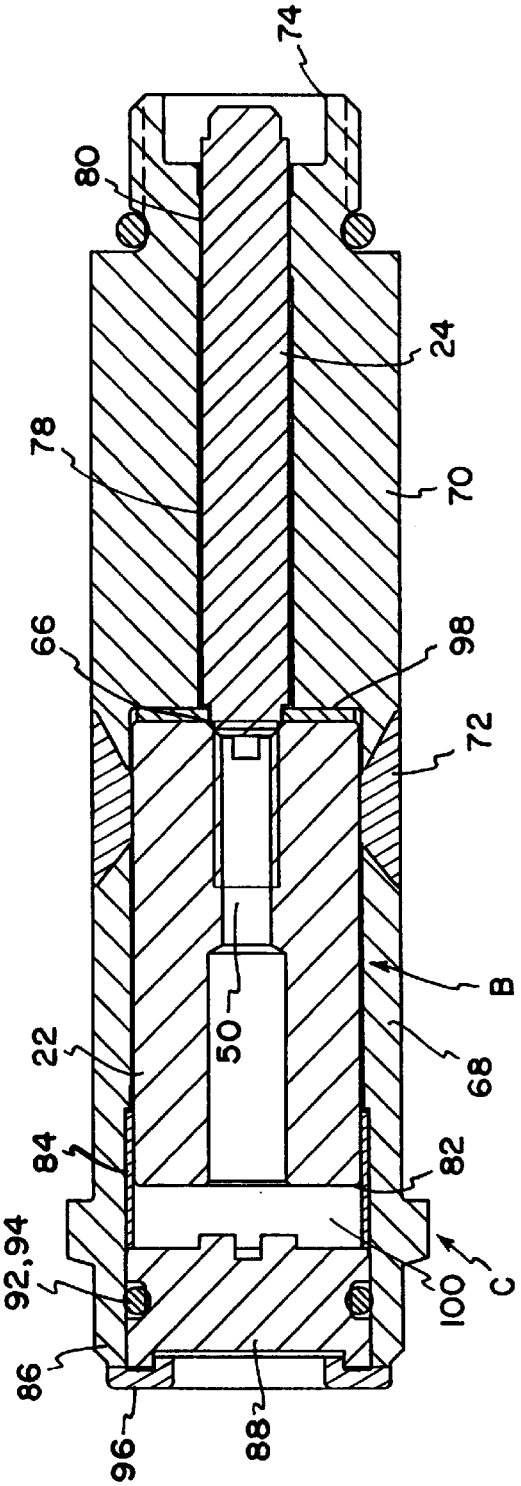
FIG. 7 is a cross-sectional view taken along section line 8—8 of FIG. 7, the armature pin is shown mounted within the armature housing.

As shown in FIG. 7, the armature housing C includes a first ferromagnetic piece 68 separated from a second ferromagnetic piece 70 by an annular non-ferromagnetic piece 72. The first and second ferromagnetic pieces 68 and 70 can be made of numerous materials such as silicon, iron, steel, or resulfurized or leaded low-carbon free machining steel. Preferably, the ferromagnetic pieces 68 and 70 are machined from a single piece of ferromagnetic bar stock, thereby avoiding concentricity problems associated with prior solenoid tube assemblies. The non-ferromagnetic 72 separates the ferromagnetic pieces 68 and 70 and creates an interrupted magnetic flux path or pole piece. Preferably, the non-ferromagnetic material will be a copper alloy such as silicon bronze or aluminum bronze. The non-ferromagnetic piece 72 is also arranged and configured to form a bearing for supporting the armature 22 within the armature housing C.

The second ferromagnetic piece 70 includes a front end 74 adapted to be connected to a mechanism designed to be controlled by the solenoid 20. For example, the front end 74 can include external or internal threads for allowing the solenoid 20 to be connected to a mechanism such as a valve assembly.

The second ferromagnetic piece 70 also defines an axial pin bore 78 sized and shaped for receiving the armature pin 24. The pin bore 78 is generally cylindrical and has a generally circular cross-section. A pin bearing 80 is preferably formed within the pin bore 78 for supporting the armature pin 24 within the bore 78. The pin bearing 80 preferably comprises an annular ring that projects within the pin bore 78 for supporting the armature pin 24. It is preferred for the pin bearing 80 to be unitarily formed with the second ferromagnetic piece 70. Consequently, a separate bearing member is not required to be press fit or otherwise attached within the pin bore 78 to support the pin 24.

The first ferromagnetic piece 68 defines a cylindrical armature chamber 82 sized for receiving the armature 22. As previously described, the non-ferromagnetic piece 72 forms a bearing for supporting the armature 22 within the armature chamber 82. Additionally, another armature bearing 84 is located within the armature chamber 82 at a location offset from the non-ferromagnetic piece 72. Preferably, the second armature bearing 84 is press fit within an annular slot defined by the interior surface of the first ferromagnetic piece 68. One skilled in the art will readily recognize that the second armature bearing 84 does not need to be press-fitted. It may be a brazement bearing similar to the pin bearing 80 or some other form of a bearing. The armature bearing formed by the non-ferromagnetic piece 72 and the second armature bearing 84 cooperate to evenly support the armature 22 within the armature chamber 82.

The first ferromagnetic piece 68 also includes a rear end 86 that is closed by an end plug 88. The end plug 88 is generally cylindrical and defines an axially spaced annular groove 92. An annular sealing member 94 is mounted in the annular groove 92 and functions to seal the armature chamber 82. The end plug 88 is retained within the rear end 86 of the second ferromagnetic piece 70 by an annular crimp 96 that fits around the end plug 88.

As assembled, the armature 22 is reciprocally mounted within the armature chamber 82 and the armature pin 24 is reciprocally mounted within the pin bore 78. One of the chamfered end portions 66 of the armature pin 24 fits within the pin receiving portion 60 of the armature 22. In typical use, the armature pin 24 is pressure biased against the armature 22 such that the two pieces remain in constant contact and move together in tandem. Void spaces within the armature chamber 82 and pin bore 78 are preferably filled with a fluid such as oil.

When the armature 22 and armature pin 24 move from right to left within the armature housing C, the oil within the armature chamber 82 moves from left to right through the fluid passage 50. Specifically, the fluid moves through the fluid passage 50 and around the armature pin 24 via the bypass slot 62. The oil also flows from left to right through the pin bore 78 and exits the pin bore 78 past the pin bearing 80. It will be appreciated that the armature pin 24 does not interfere with flow through the pin bore 78 because the pin 24 has a hexagonal cross-section while the pin bore and pin bearing 80 have round cross-sections. As a result, the spacing between the flat surfaces 67 of the armature pin 24 and the curved surfaces of the pin bore 78 and the pin bearing 80 provide fluid passageways for allowing displacement flow through the pin bore 78. It will be appreciated that when the armature assembly B is moved from left to right, oil flows through the solenoid 20 in an opposite direction from that previously described.

To prevent hydraulic lock when the armature assembly B reciprocates within the solenoid, a non-ferromagnetic washer 98 is located at one end of the armature chamber 82. The washer 98 includes three legs for centering the washer within the armature chamber 82. At the other end of the armature chamber 82, the end plug 88 defines a stop 100 configured for engaging the armature 22 when the armature completes a back stroke.

Figure 8:
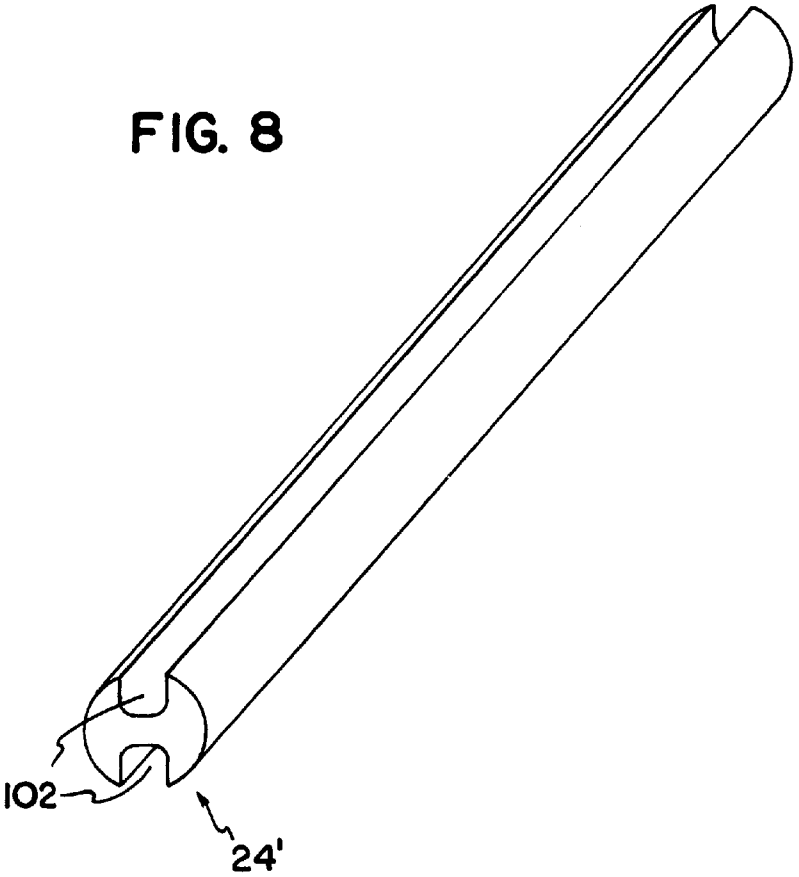
FIG. 8 is a perspective view of an alternative armature pin constructed in accordance with the principles of the present invention.

FIG. 8 illustrates an alternative armature pin 24' that can be used in accordance with the principles of the present invention. The pin 24' includes two longitudinal slots 102 extending along the entire length of the pin 24'. The slots 102 have generally C-shaped cross-sections and are configured for providing a fluid flow path along the pin 24'. It will be appreciated that the two slots specifically shown in FIG. 8 are strictly exemplary and that any number of slots having any number of shapes could also be used. Furthermore, in certain embodiments of the present invention the slots may not extend along the entire length of the armature pin.

Figure 9:
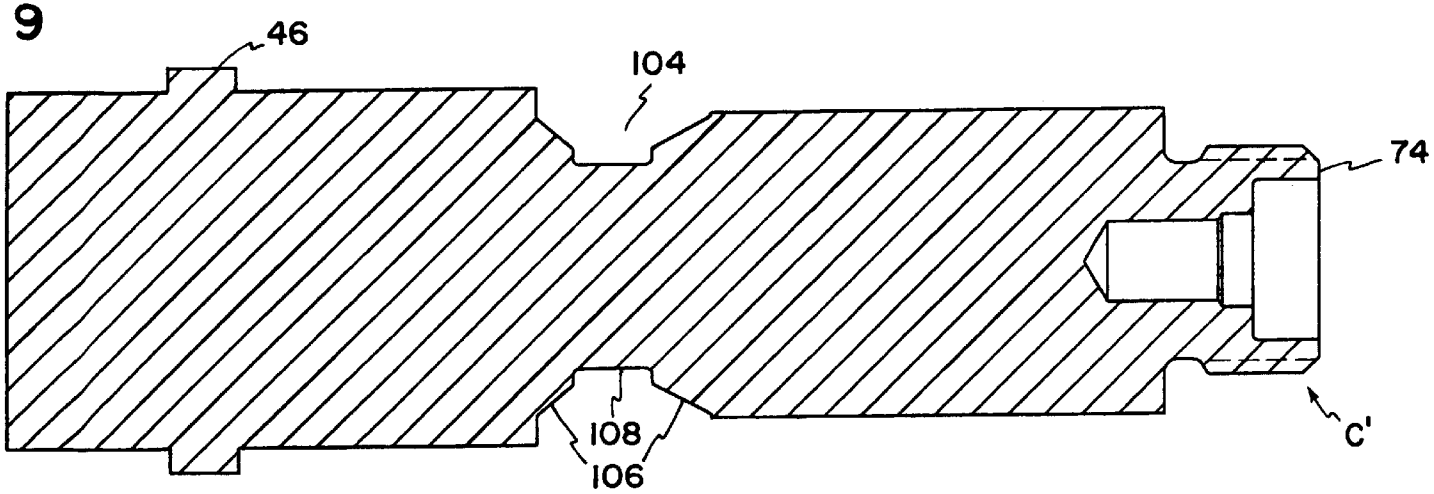

Referring now to FIGS. 9–14, steps for manufacturing an armature housing C in accordance with the principles of the present invention are described. Initially, a precursor armature housing C' begins as a solid piece of ferromagnetic cylindrical bar stock. FIG. 9 illustrates the precursor armature housing C' after a first phase of the preferred manufacturing process. In the first phase, the bar stock is placed on a turning machine such as an automatic machining lathe. In this phase, the outer surface of the cylindrical bar stock is machined to form features such as the flange 46 having wrench flats, and the external valve engaging portion of the front end 74. A groove 104 is also formed about the perimeter of the bar stock. The groove has two converging tapered walls 106 separated by a rectangular portion 108.

Figure 11:
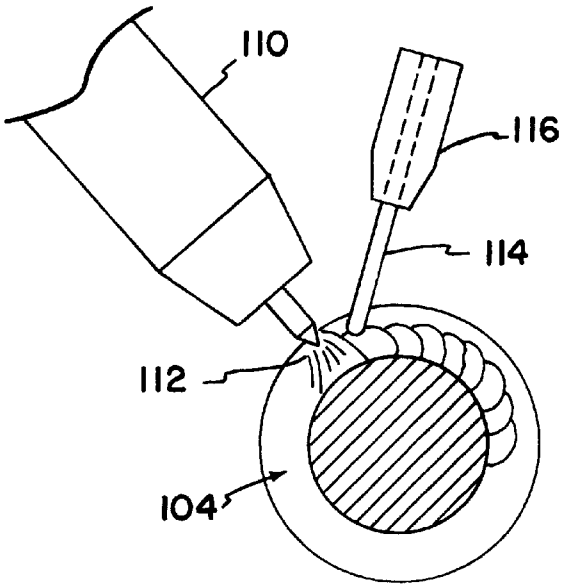
FIGS. 9–14 show a sequence of manufacturing steps for making a solenoid in accordance with the principles of the present invention.
Figure 10:
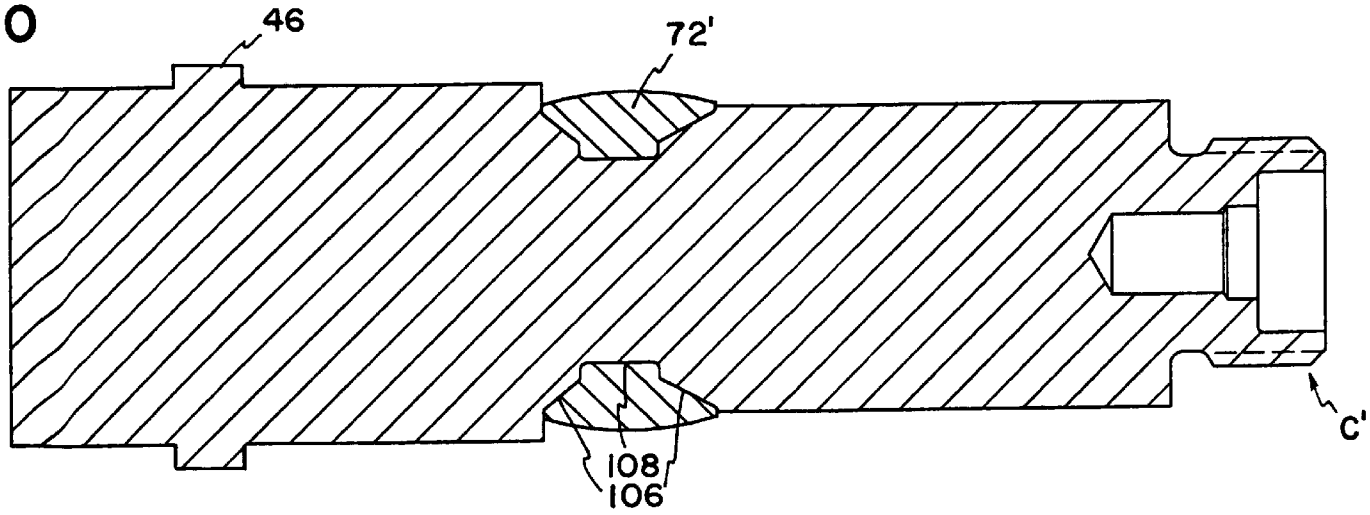

FIG. 10 illustrates the precursor armature housing C' after a second phase of the preferred manufacturing process. In the second phase, the groove 104 is filled with non-ferromagnetic material 72'. The groove can be filled by a variety of techniques such as depositing, bonding, brazing, or cladding. A preferred method of filling the groove 104 is by gas tungsten brazing as shown in FIG. 11. Using such a technique, a gas tungsten arc welder 110 is positioned adjacent to the groove 104 to produce the required arc 112. Non-ferromagnetic filler material 114 is delivered into the arc 112 via a continuous cold wire feed 116 that is positioned next to the gas tungsten arc welder 110. The non-ferromagnetic material 114 is fed into the arc 112 at the trailing edge of the arc heat source 110. The arc 112 melts a non-ferromagnetic material 114 and the groove 104 is filled. The arc 112 melts the non-ferromagnetic material 114 without significantly heating the precursor armature housing C' which results in negligible dilution or diffusion between the precursor armature housing C' and the filler material 114. The wire 116 is moved back and forth across a groove 104 during filling to ensure a uniform fill which completely spans the groove 104. The precursor armature housing C' is also rotated clockwise to provide a uniform distribution of the filler material 114 in the groove 104. Alternative methods of filling the groove 104 include using a plasma arc, a torch, a welding arc, or a metal arc.

Figure 12:
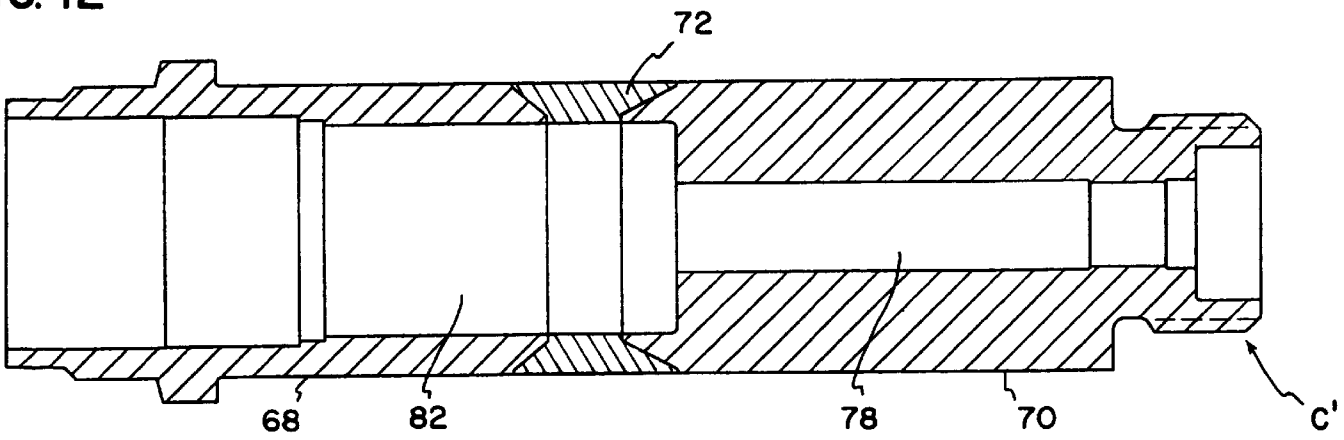

Referring to FIG. 12, during the third phase of the preferred manufacturing process, the pin bore 78 and the armature chamber 82 are machined into the precursor armature housing C'. Prior to machining the armature chamber 82, the precursor armature housing C' is composed of a single piece of ferromagnetic bar stock. Upon machining the armature chamber 82, the precursor armature housing C' is divided into the first and second ferromagnetic pieces 68 and 70. The first and second ferromagnetic pieces are separated by the non-ferromagnetic magnetic piece 72 which mechanically interconnects the two ferromagnetic pieces 68 and 70. Also during this phase, the precursor housing C' is machined for receiving the end plug 88, and excess material from the exterior surface of the precursor armature housing C' is removed such that an area for installing the coil unit A is produced.

Figure 13:
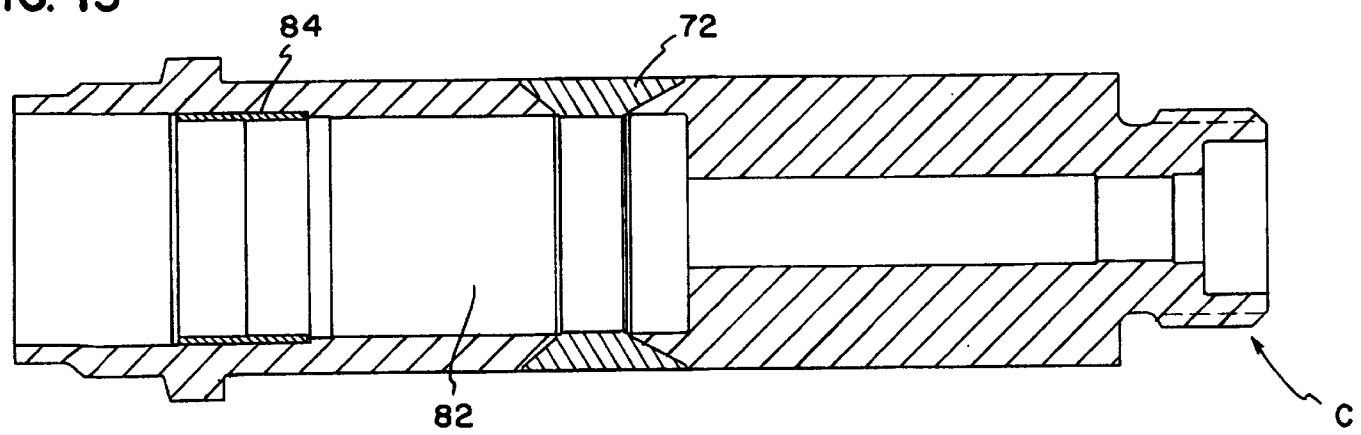

FIG. 13 illustrates a fourth phase of the manufacturing process. In the fourth phase, the armature bearing 84 is press fitted into a bearing seat which has been machined into the armature housing C at a location offset from the non-ferromagnetic piece 72. The non-ferromagnetic piece 72 and the armature bearing 84 cooperate to support the armature 22 within the armature chamber 82.

Figure 14:
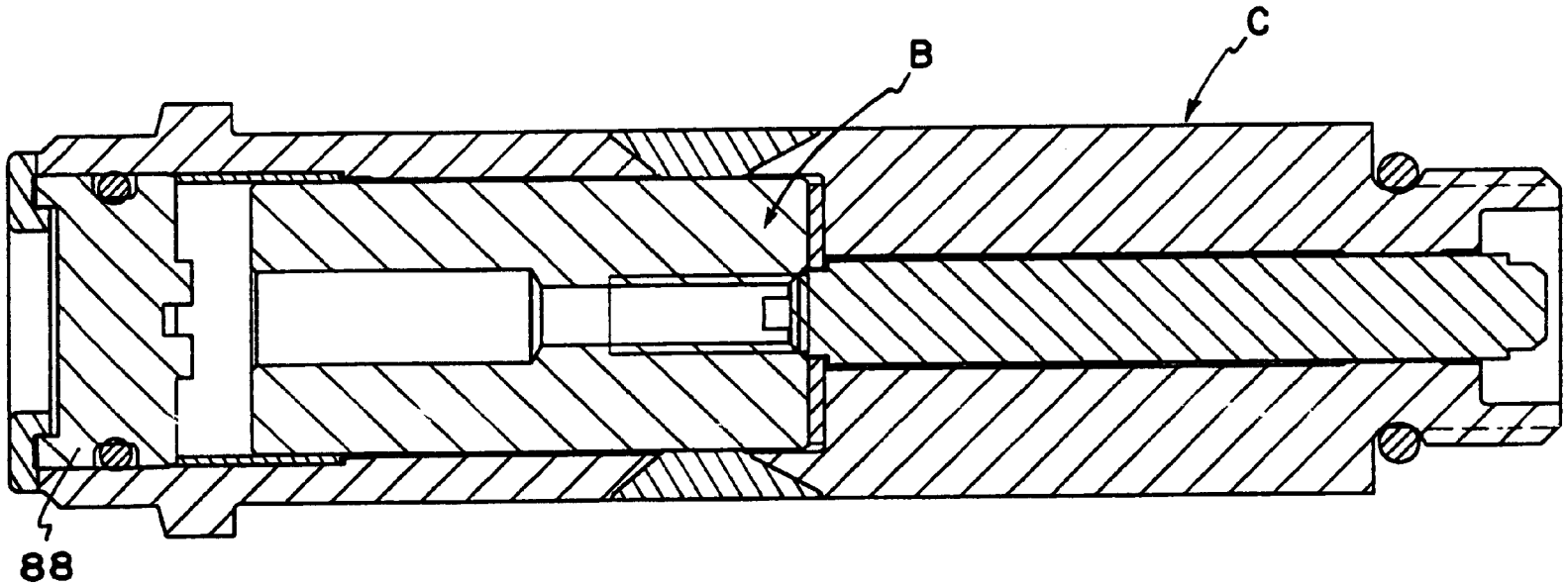

FIG. 14 illustrates the final phase of the preferred manufacturing process. As shown in FIG. 14, the armature assembly B is reciprocally mounted within the armature housing C and one end of the armature housing is enclosed by the plug 88.

With regard to the foregoing description, it is to be understood that changes may be made in detail, especially in matters of the construction materials employed and the shape, size, and arrangement of the parts without departing from the scope of the present invention. It is intended that the specification and depicted embodiment be considered exemplary only, with a true scope and spirit of the invention being indicated by the broad meaning of the following claims.

We claim:

1. A method for producing a solenoid housing comprising:

providing a single piece ferromagnetic armature housing;

forming a groove around the perimeter of the housing;

filling the groove with a non-ferromagnetic material such that the non-ferromagnetic material forms an annular non-ferromagnetic piece that spans the entire groove; and removing material from the armature housing such that two ferromagnetic pieces are separated by the non-ferromagnetic piece within the single piece ferromagnetic armature housing.

2. The method of claim 1, wherein the groove is filled by a process selected from the group consisting essentially of depositing, bonding, and cladding.

3. The method of claim 1, wherein the groove is filled by gas tungsten brazing.

4. The method of claim 1, wherein the non-ferromagnetic material is a copper alloy.

5. The method of claim 1, wherein the ferromagnetic material is steel.

6. The method of claim 1, wherein the groove is filled by:

fixing a heat source in position to produce a desired weld at the groove;

feeding a filler material into the heat source at a trailing edge of the heat source;

moving the filler material back and forth within the groove; and rotating the housing to produce a uniform distribution of the filler material in the groove.

7. A method according to claim 6, wherein the heat source is selected from the group consisting essentially of a plasma arc, a torch, a welding arc, and a metal arc.

* * * * *